US007410271B1

(12) United States Patent
Man

(10) Patent No.: US 7,410,271 B1
(45) Date of Patent: Aug. 12, 2008

(54) FLASHLIGHT WITH AUTOMATIC LIGHT INTENSITY ADJUSTMENT MEANS

(75) Inventor: Shiu-Fai Stephen Man, N.T. (HK)

(73) Assignee: Kaper Industrial Limited, N.T. (HK)

( * ) Notice: Subject to any disclaimer, the term of this patent is extended or adjusted under 35 U.S.C. 154(b) by 16 days.

(21) Appl. No.: 11/675,100

(22) Filed: Feb. 15, 2007

(51) Int. Cl.
*F21V 33/00* (2006.01)

(52) U.S. Cl. ..... 362/184; 362/295; 362/205

(58) Field of Classification Search ..... 362/184, 362/295, 276, 234, 157, 394
See application file for complete search history.

(56) References Cited

U.S. PATENT DOCUMENTS 3,729,262 A * 4/1973 Snead et al. ..... 356/153
4,546,420 A * 10/1985 Wheeler et al. ..... 362/268
4,618,254 A * 10/1986 Therrien et al. ..... 355/68
4,631,675 A * 12/1986 Jacobsen et al. ..... 700/90
4,896,370 A * 1/1990 Kasparian et al. ..... 455/77
5,701,481 A * 12/1997 Hosaka et al. ..... 718/106
2003/0020617 A1* 1/2003 Tice et al. ..... 340/600
2005/0122712 A1* 6/2005 Kim ..... 362/184

* cited by examiner

*Primary Examiner*—Ali Alavi

(57) ABSTRACT

A flashlight with automatic light intensity adjustment means comprising a flashlight casing, a light source, a switch, a light controlling circuit on a printed circuit board and a power source, wherein a sensor component is attached to the flashlight casing, and the sensor component comprises a sensor casing and an incident light intensity sensor disposed therein, and the sensor is electronically connected to the light source, the switch, the light controlling circuit and the power source, and the light controlling circuit controls electrical current passing through the light source according to intensity of incident light as detected by the sensor so that more current is passed through the light source when a lower intensity of incident light is detected, and less current is passed through the light source when a higher intensity of incident light is detected.

10 Claims, 4 Drawing Sheets

FLASHLIGHT WITH AUTOMATIC LIGHT INTENSITY ADJUSTMENT MEANS

BACKGROUND OF THE INVENTION

The present invention relates to a flashlight with automatic light intensity adjustment means and more particularly pertains to a flashlight capable of automatically adjusting the light intensity according to the intensity of incident light reflected from the nearest object facing the light source of the flashlight.

Flashlights are indispensable for household use. For example, when there is an outage of electricity, it is necessary to use flashlight to light the way. In some instances when household hardware which is located in relatively dark corners of the house, such as fuse box and pipelines, is damaged, it is also necessary to use flashlight to light the dark corners to repair the damaged hardware.

Flashlights are also indispensable for various outdoor activities such as camping and mountain climbing. Especially in countryside where public lighting facilities and installations are rare, it is essential for people to use their own flashlights for conducting various activities in the dark, such as reading the map, finding the way and so forth. If the light intensity of the flashlight is not high enough, only the area within a limited distance can be illuminated and so users are prone to get injured by running into obstacles in the dark. However, if the light intensity of the torch is too high, it is difficult for the human eyes to adapt to the strong light in the dark and so users cannot see things clearly in the adjacent area. This poses serious problems especially for map reading. To solve the aforementioned problem, some flashlights available in the marketplace are equipped with manual light intensity adjustment means. However, they are not user-friendly and user usually wastes much effort on switching to the suitable level of light intensity. Therefore, there is a need for flashlights with automatic light intensity means which can conveniently provide the appropriate level of light for users.

BRIEF SUMMARY OF THE INVENTION

In view of the aforesaid disadvantages now present in the prior art, the present invention provides a flashlight capable of detecting the intensity of light as reflected by the nearest object facing the light source of the flashlight and automatically adjusting the light intensity according to the light intensity of light as detected by the flashlight. In principle, the farther away an object is located from the light source of the flashlight, the less intense is the light reflected by the object, and the flashlight is automatically adjusted to provide stronger light. Furthermore, the lower the reflectivity of the surface of the object, the less intense is the light reflected by the object and the flashlight is automatically adjusted to provide stronger light. The present invention therefore provides users with optimal level of lighting in the dark without blinding users with bright light. The automatic adjustment means also saves users the trouble of manually adjusting the light intensity.

To attain this, the present invention generally comprises a flashlight comprising a flashlight casing, a light source, a switch, a light controlling circuit on a printed circuit board and a power source, wherein a sensor component is attached to the flashlight casing, and the sensor component comprises a sensor casing and an incident light intensity sensor disposed therein, and the sensor is electronically connected to the light source, the switch, the light controlling circuit and the power source, and the light controlling circuit controls electrical current passing through the light source according to intensity of incident light as detected by the sensor so that more current is passed through the light source when a lower intensity of incident light is detected, and less current is passed through the light source when a higher intensity of incident light is detected.

The sensor casing is elongated in shape, and the interior surface of the sensor casing is dark in color.

A plurality of discs are disposed inside the sensor casing, and each of the discs is disposed with a center through hole so that light passes through the through holes before reaching the sensor.

In one preferred embodiment, the printed circuit board is disposed inside the flashlight casing, and the sensor is connected to the printed circuit board by means of wires passing through an opening in the flashlight casing. In other embodiments, the sensor may be connected to the printed circuit board by other conventional means.

In another embodiment, the printed circuit board is disposed inside the sensor casing, and the sensor is connected to the printed circuit board by means of wires or other conventional means.

The light controlling circuit is configured to provide a current stabilizing function which stabilizes the electrical current passing through the light source when the intensity of incident light as detected by the sensor fluctuates.

In one preferred embodiment, the light controlling circuit is configured to provide a booster function, and a booster switch is provided on the flashlight casing for the user to activate the booster function. The booster switch and the switch may be configured as two separate switches or incorporated as a single 3-way switch.

In one preferred embodiment, the sensor takes the form of a photoresistor.

In another embodiment, the sensor takes the form of an infrared light sensor, and an infrared light emitter is disposed in the sensor casing to emit infrared light in a direction which is parallel to the light emitted by the light source.

The light controlling circuit may take the form of an integrated circuit which is preset with one or more incident light intensity threshold levels, each of which corresponds to a preset level of electrical current to be controlled by the integrated circuit to pass through the light source.

By the provision of the sensor casing, the sensor is prevented from receiving light which is not reflected by the nearest object facing the light source of the flashlight. The present invention can therefore determine the intensity of incident light reflected from the nearest object facing the flashlight more accurately, thereby providing a more appropriate light level accordingly.

Furthermore, since the flashlight of the present invention is capable of automatically adjusting the light intensity according to the lighting needs of the users, the present invention can reduce wastage of energy to provide excessive light. The battery life of the present invention can therefore be maximized.

It is an object of the present invention to provide a portable lighting apparatus capable of automatically adjusting the light intensity according to the distance between the flashlight and the nearest object facing the light source of the flashlight.

It is another object of the present invention to provide a sensor component which is prevented from being affected by ambient light which are not reflected by the nearest object facing the light source of the flashlight.

A further object of the present invention is to provide a portable lighting apparatus which is environmentally friendly.

An even further object of the present invention is to provide an automatic light adjustment means for portable light apparatus which has a simple structure and low manufacturing cost, thus overcoming the disadvantages of the prior art.

DETAILED DESCRIPTION OF THE INVENTION

Figure 1:
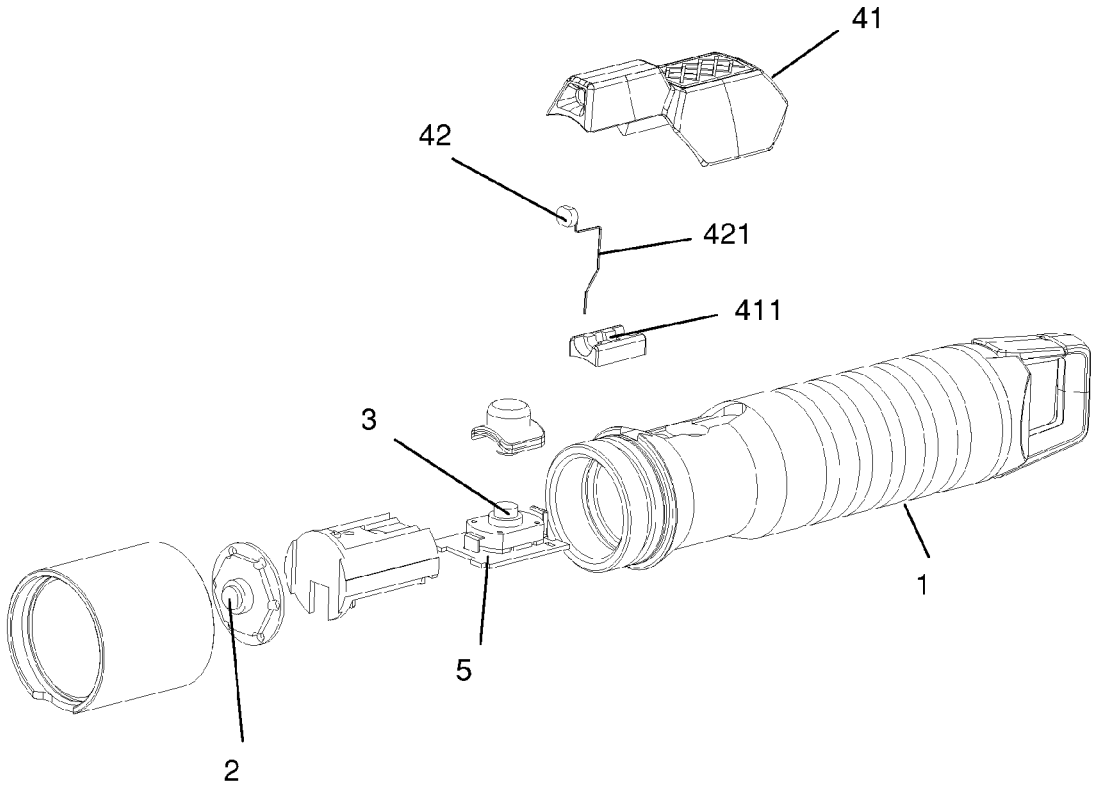
FIG. 1 is an exploded view of the first embodiment of the present invention.
Figure 2:
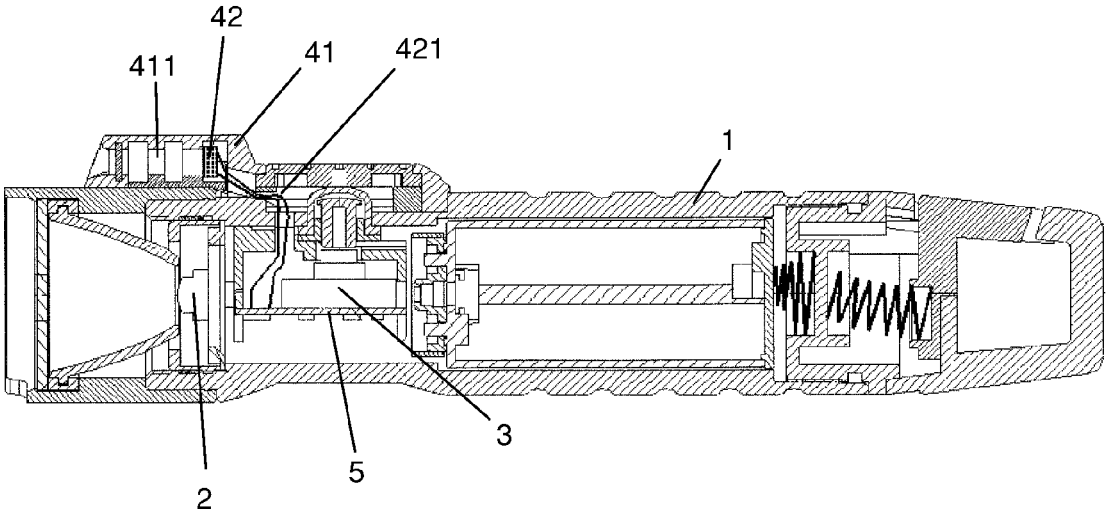
FIG. 2 is a cross-sectional view of the first embodiment of the present invention.
Figure 3:
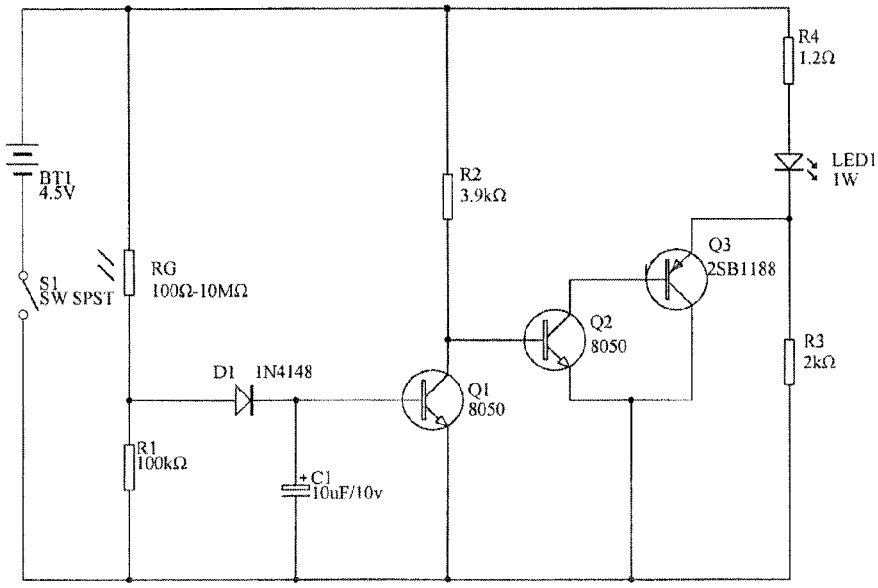
FIG. 3 is a circuit diagram of the first embodiment of the present invention.

As illustrated in FIGS. 1 to 3, the present invention comprises a flashlight casing 1, a light source 2, a switch 3, a light controlling circuit on a printed circuit board 5 and a power source. In the present embodiment, the power source takes the form of three 1.5V batteries, providing a voltage of 4.5V. A sensor component is attached to the flashlight casing 1, and the sensor component comprises a sensor casing 41 and a sensor 42 disposed therein. The sensor casing 41 is elongated in shape, and the interior surface of the sensor casing 41 is dark in color. A plurality of discs 411 are disposed inside the sensor casing 41, and each of the discs 411 is disposed with a center through hole 412 so that light passes through the through holes 412 before reaching the sensor 42. In this embodiment, the printed circuit board 5 is disposed inside the flashlight casing 1. The sensor 42 is connected to the printed circuit board 5 by means of wires 421 passing through an opening in the flashlight casing 1. In other embodiments, the printed circuit board 5 may also be disposed inside the sensor casing 41, and the sensor 42 may be connected to the printed circuit board 5 by other conventional means.

In this embodiment, the sensor 42 is a photoresistor. The sensor 42 is electronically connected to the light source 2, the switch 3, the light controlling circuit and the power source. The light controlling circuit controls electrical current passing through the light source 2 according to the intensity of incident light as detected by the sensor 42. When the user switches on the flashlight, light is emitted from the light source 2. When the emitted light hits the nearest object facing the light source 2, the light will be reflected by the object towards the flashlight. The light reflected by the object constitutes the incident light which passes through the through holes 412 in the sensor casing 41 before reaching the sensor 42. The elongated sensor casing 41 effectively blocks the light not reflected by the object and therefore eliminates the influence of ambient light. The farther away an object is located from the light source 2, the less intense is the light reflected by the object, and so the intensity of incident light as detected by the sensor 42 is lower. Moreover, the lower the reflectivity of the surface of an object, the less intense is the light reflected by the object, and so the intensity of the incident light as detected by the sensor 42 is lower. A lower incident light intensity detected by the sensor 42 implies that more light is required to light the object, and so the light controlling circuit passes more electrical current through the light source 2 to provide stronger light. On the contrary, the nearer an object is located from the light source 2, and the higher the reflectivity of the surface of an object, the intensity of incident light as detected by the sensor 42 is higher, and so less electrical current is passed through the light source 2 to provide weaker light. The light controlling circuit is also configured to provide a current stabilizing function which stabilizes the electrical current passing through the light source 2 when the intensity of incident light as detected by the sensor 42 fluctuates.

FIG. 3 further illustrates the circuit diagram of the light controlling circuit of the first embodiment. As illustrated in FIG. 3, the light controlling circuit comprises batteries BT1, switch S1, photoresistor RG, light emitting diode LED1, resistors R1, R2, R3 and R4, a diode D1, a capacitor C1, a PNP transistor Q3, and two NPN transistors Q1 and Q2. The batteries BT1 (which constitute the power source) is connected to the light emitting diode LED1 (which constitutes the light source 2) through the switch S1 (which constitutes the switch 3). The photoresistor RG and the resistor R1 function as a voltage divider to control the voltage of the positive pole of the diode D1. The diode D1, the capacitor C1 and the NPN transistor Q1 and the resistor R2 function as a time delay circuit. The NPN transistor Q2 and the PNP transistor Q3 function as a current amplifying circuit. The resistors R4 and R3 form a current limiting circuit. When the incident light intensity detected by the photoresistor RG is low, the photoresistor RG signals the resistor R1 to impose low voltage to the diode D1. The base of the NPN transistor Q1 receives a voltage too low for the NPN transistor Q1 to be conductive for the flow of electrical current. The collector of the NPN transistor Q1 receives high voltage and the base of the NPN transistor Q2 receives high voltage, thus the NPN transistor Q2 becomes conductive for the flow of electrical current. The collector of NPN transistor Q2 receives low voltage and the PNP transistor Q3 becomes conductive for the flow of electrical current. Electrical current $I_{ce}$ is large, therefore the electrical current passing through the resistor R4 is large, and the light emitting diode LED1 emits stronger light. On the contrary, when the incident light intensity detected by the photoresistor RG is high, the voltage to be divided by the resistor R1 changes from low to high. The electrical current passing through diode D1 is stored in the capacitor C1. When the voltage of the two ends of the capacitor C1 is high enough to reach the conductive voltage level of the NPN transistor Q1 after charging, the collector and the emitter of the NPN transistor Q1 are conductive and the electrical current of which changes from weak to strong. The electrical current of the collectors and emitters of the NPN transistor Q2 and PNP transistor Q3 reversely change from strong to weak. Therefore, electrical current for the resistor R4 decreases. The light emitting diode LED1 emits weaker light.

Figure 4:
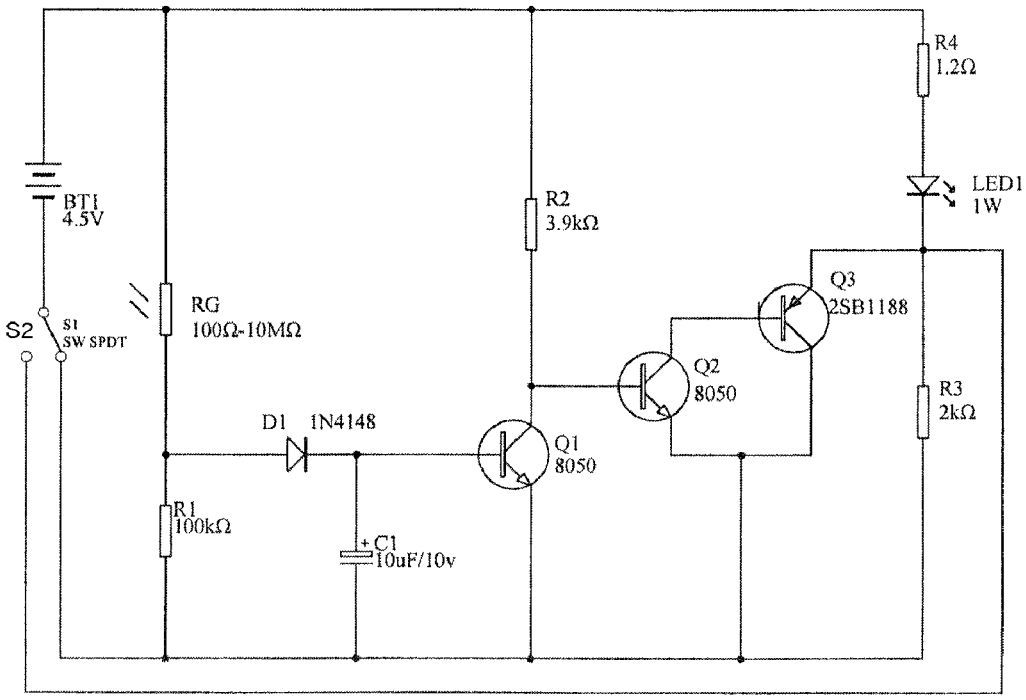
FIG. 4 is a circuit diagram of the second embodiment of the present invention.

FIG. 4 is a circuit diagram of the second embodiment of the present invention. The structure of the second embodiment is very similar to the first embodiment, except that the flashlight of the second embodiment also provides a booster function. To achieve this, the switch 3 in the first embodiment is converted to a 3-way switch commonly available in the marketplace, for example, a 3-way rocker switch which allows the user to switch the flashlight to one of the three states, namely "on", "off" and "boost". Accordingly, the switch S1 of the light controlling circuit in the first embodiment is replaced by a 3-way switch. When the user switches the flashlight to the "boost" state, the 3-way switch in the light controlling circuit connects with the terminal S2 and so electrical current passes through the light emitting diode LED1 via the resistor R4 only. Therefore, the light emitting diode LED1 emits the maximum amount of light.

Figure 5:
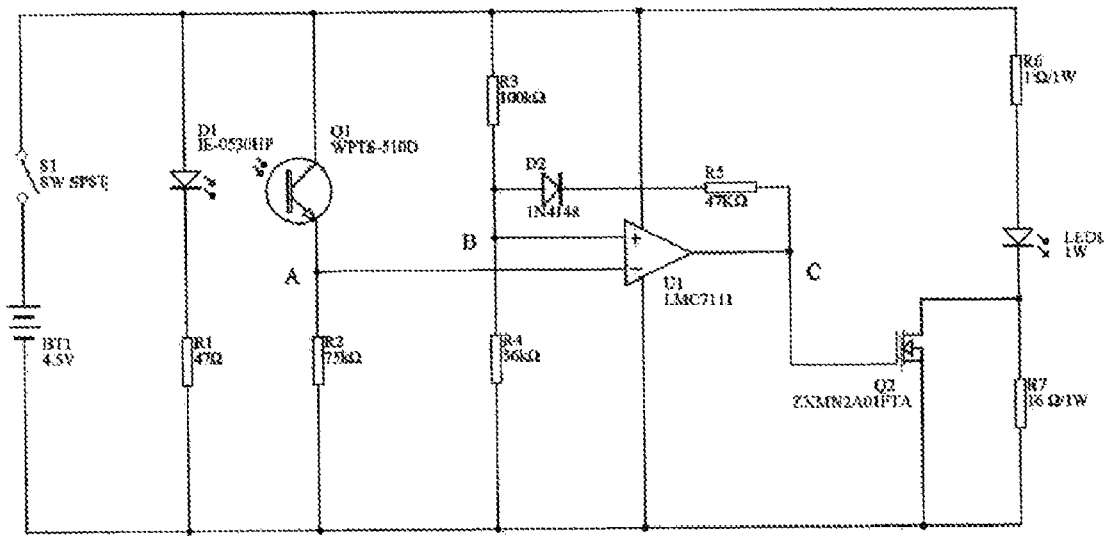
FIG. 5 is a circuit diagram of the third embodiment of the present invention.

FIG. 5 is a circuit diagram of the third embodiment of the present invention in which the sensor 42 takes the form of an infrared light sensor. The structure of the third embodiment is very similar to the first embodiment, except that an infrared light emitter is disposed in the sensor casing 41 to emit infrared light in a direction which is parallel to the light emitted by the light source 2. Accordingly, the light controlling circuit of the third embodiment comprises batteries BT1 (which constitute the power source), switch S1 (which constitutes the switch 3), light emitting diode LED1 (which constitutes the light source 2), resistors R1, R2, R3, R4, R5, R6 and R7, an infrared light emitting diode D1 (which constitutes the infrared light emitter), a voltage comparator U1 and two transistors Q1 and Q2. The diode D1 and the resistor R1 function as an infrared light transmitting circuit. The NPN transistor Q1 and the resistor R2 function as an infrared light receiving circuit (which constitutes the infrared sensor). The resistors R3, R4, R5, the diode D2 and the voltage comparator U1 functions as a voltage comparing circuit. The transistor Q2 functions as a switch. The resistors R6 and R7 functions as a circuit limiting circuit.

In this embodiment, the light controlling circuit is configured to provide two lighting levels. When the user switches on the flashlight, the diode D1 emits infrared light and the infrared light hits the nearest object in front of the flashlight. When there is an object located beyond a certain distance, for example, beyond 1 m in this embodiment, from the light source 2, the intensity of the infrared light reflected by the object is lower, and so the intensity of incident infrared light as detected by the infrared light receiving circuit is lower. If the intensity of the incident infrared light as detected by the infrared light receiving circuit is lower than a specific level, the voltage at the connecting point A is lower than that at the connecting point B, and so the voltage comparator U1 outputs high voltage. Since the voltage at connecting point C is high, the transistor Q2 becomes conductive. The electrical current after passing through the resistor R6, the light emitting diode LED1 and the transistor Q2 is strong, thus the light emitting diode LED1 emits stronger light. On the contrary, where there is an object located within a certain distance, for example, within 1 m in this embodiment, from the light source 2, the intensity of the infrared light reflected by the object is higher, and so the intensity of incident infrared light as detected by the infrared light receiving circuit is higher. If the intensity of the incident infrared light as detected by the infrared light receiving circuit is higher than a specific level, the voltage at the connecting point A is higher than that at the connecting point B. The voltage comparator U1 outputs low voltage. Since the voltage at the connecting point C is low, the transistor Q2 is closed for the flow of the electrical current. The electrical current passing through the resistor R6, the light emitting diode LED1 and the resistor R7 is weak, thus the light emitting diode LED1 emits weaker light.

Figure 6:
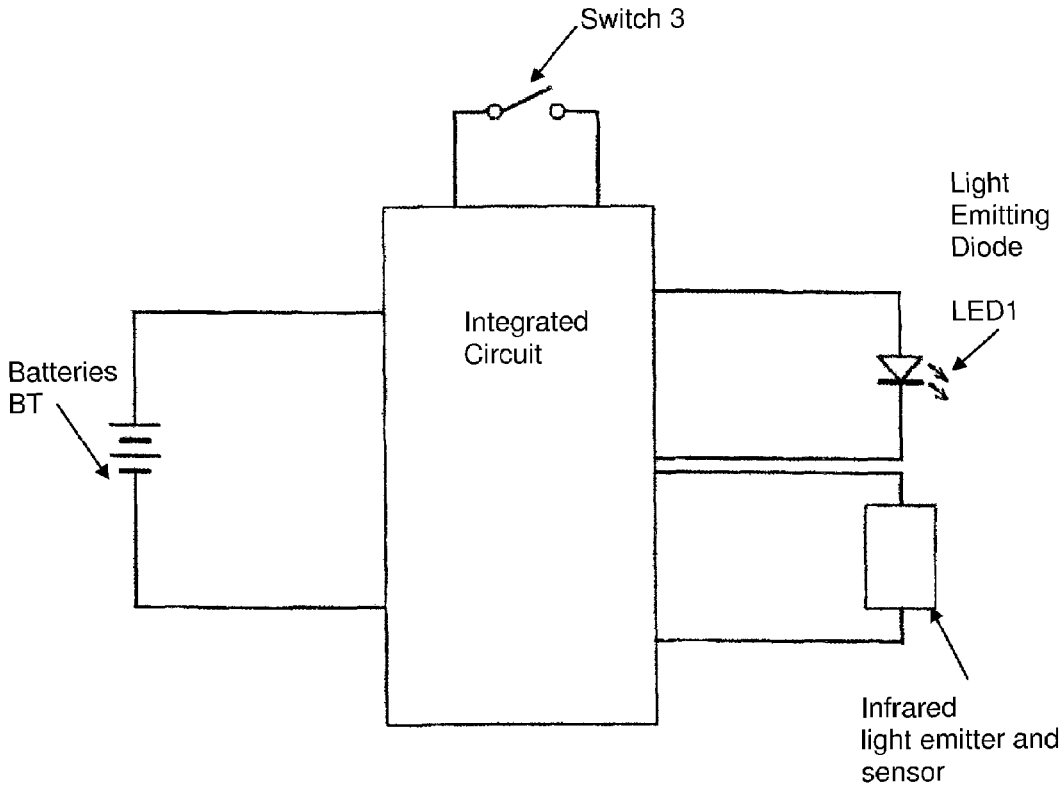
FIG. 6 is a block diagram of the fourth embodiment of the present invention.

FIG. 6 shows a block diagram of the fourth embodiment of the present invention. In this embodiment, the light controlling circuit takes the form of an integrated circuit which is preset with one or more incident light intensity threshold levels, each of which corresponds to a preset level of electrical current to be controlled by the integrated circuit to pass through the light source. In this embodiment, two incident light intensity threshold levels are preset in the integrated circuit. When the incident light intensity detected is below the lower threshold level, the integrated circuit controls the electrical current passing through the light source to be at the highest level. When the incident light intensity level detected is between the lower threshold level and the higher threshold level, the integrated circuit controls the electrical current passing through the light source to be at the middle level. When the incident light intensity level detected exceeds the higher threshold level, the integrated circuit controls the electrical current passing through the light source to be at the lowest level. In other words, in this embodiment, the light source is controlled by the integrated circuit to emit three levels of light. Depending on the number of preset incident light intensity threshold levels in the integrated circuit, it should be conceivable that the light source can be controlled to emit light of a wide range of intensity according to the incident light intensity as detected.

As to a further discussion of the manner of usage and operation of the present invention, the same should be apparent from the above description. Accordingly, no further discussion relating to the manner of usage and operation is provided.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

The present invention is capable of other embodiments and of being practiced and carried out in various ways. It is to be understood that the phraseology and terminology employed herein are for the purpose of description and should not be regarded as limiting.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed is:

1. A flashlight with automatic light intensity adjustment means which comprises a flashlight casing, a light source, a switch, a light controlling circuit on a printed circuit board and a power source, wherein a sensor component is attached to the flashlight casing, and the sensor component comprises a sensor casing and an incident light intensity sensor disposed therein, and the sensor is electronically connected to the light source, the switch, the light controlling circuit and the power source, and the light controlling circuit controls electrical current passing through the light source according to intensity of incident light as detected by the sensor so that more current is passed through the light source when a lower intensity of incident light is detected, and less current is passed through the light source when a higher intensity of incident light is detected.

2. A flashlight with automatic light intensity adjustment means as in claim 1, wherein the sensor casing is elongated in shape, and the sensor casing has an interior surface which is dark in color.

3. A flashlight with automatic light intensity adjustment means as in claim 1, wherein a plurality of discs are disposed inside the sensor casing, and each of the discs is disposed with a center through hole so that light passes through the through holes before reaching the sensor.

4. A flashlight with automatic light intensity adjustment means as in claim 1, wherein the printed circuit board is disposed inside the flashlight casing, and the sensor is connected to the printed circuit board by means of wires passing through an opening in the flashlight casing.

5. A flashlight with automatic light intensity adjustment means as in claim 1, wherein the printed circuit board is disposed inside the sensor casing, and the sensor is connected to the printed circuit board by means of wires.

6. A flashlight with automatic light intensity adjustment means as in claim 1, wherein the light controlling circuit is configured to provide a current stabilizing function which stabilizes the electrical current passing through the light source when the intensity of incident light as detected by the sensor fluctuates.

7. A flashlight with automatic light intensity adjustment means as in claim 1, wherein the light controlling circuit is configured to provide a booster function, and a booster switch is provided on the flashlight casing for user to activate the booster function, and the booster switch and the switch are configured as two separate switches or incorporated as a single 3-way switch.

8. A flashlight with automatic light intensity adjustment means as in claim 1, wherein the sensor takes the form of a photoresistor.

9. A flashlight with automatic light intensity adjustment means as in claim 1, wherein the sensor takes the form of an infrared light sensor, and an infrared light emitter is disposed in the sensor casing to emit infrared light in a direction which is parallel to light emitted by the light source.

10. A flashlight with automatic light intensity adjustment means as in claim 1, wherein the light controlling circuit takes the form of an integrated circuit which is preset with one or more incident light intensity threshold levels, each of which corresponds to a preset level of electrical current to be controlled by the integrated circuit to pass through the light source.

* * * * *